US006860103B2

(12) United States Patent
Raghvachari

(10) Patent No.: US 6,860,103 B2
(45) Date of Patent: Mar. 1, 2005

(54) MULTIPLE-COMPRESSOR SYSTEM HAVING BASE AND TRIM COMPRESSORS

(75) Inventor: Sridharan Raghvachari, Franklin, WI (US)

(73) Assignee: Sridharan Raghavachari, Franklin, WI (US)

( * ) Notice: Subject to any disclaimer, the term of this patent is extended or adjusted under 35 U.S.C. 154(b) by 109 days.

(21) Appl. No.: 10/201,228

(22) Filed: Jul. 23, 2002

(65) Prior Publication Data

US 2003/0086789 A1 May 8, 2003

Related U.S. Application Data

(60) Provisional application No. 60/307,351, filed on Jul. 23, 2001.

(51) Int. Cl.[7] ..... F16D 31/02
(52) U.S. Cl. ..... 60/410; 60/413
(58) Field of Search ..... 60/409, 410, 412, 60/413

(56) References Cited

U.S. PATENT DOCUMENTS 5,632,146 A * 5/1997 Foss et al. ..... 60/410
6,142,740 A 11/2000 Connell ..... 417/2
6,233,954 B1 5/2001 Mehaffey et al. ..... 62/175
6,394,120 B1 5/2002 Wichert ..... 137/2
6,499,504 B2 12/2002 Wichert ..... 137/565.13
6,652,240 B2 11/2003 Wichert ..... 417/53

FOREIGN PATENT DOCUMENTS

WO WO 200019105 A1 * 4/2000 ..... F04B/49/00

OTHER PUBLICATIONS

Letter from Paul J. Glace, dated Jun. 1, 2004, regarding Honeywell XCEED product.
Honeywell Inc., "XCEED Compressed Air Control System", 1999, 1 page brochure.
Honeywell International, "XCEED Compressed Air System Solutions", Installation Instruction & Maintenance Manual, Jan. 1, 2001, pp. 1–68.

* cited by examiner

*Primary Examiner*—Thomas E. Lazo
(74) *Attorney, Agent, or Firm*—Westman, Champlin & Kelly

(57) ABSTRACT

A multi-compressor system is described, which includes a fluid distribution system, a base compressor set, a flow controller, a trim compressor set, and a trim volume. The multi-compressor system provides compressed fluid to a load device set. The fluid distribution system is coupled to the load device set. The base compressor set is coupled to the fluid distribution system. The flow controller has a downstream side coupled to the fluid distribution system, and an upstream side coupled to a trim compressor set. The trim volume is coupled between the outlet of the trim compressor set and the upstream side of the flow controller.

19 Claims, 4 Drawing Sheets

MULTIPLE-COMPRESSOR SYSTEM HAVING BASE AND TRIM COMPRESSORS

CROSS-REFERENCE TO RELATED APPLICATION

The present application is based on and claims the benefit of U.S. Provisional Patent Application No. 60/307,351, filed Jul. 23, 2001, the content of which is hereby incorporated by reference in its entirety.

FIELD OF THE INVENTION

The present invention relates to fluid compressor systems, and more particularly, fluid compressor systems with improved efficiency.

BACKGROUND OF THE INVENTION

Pressurized compressible fluids, such as atmospheric air, carbon dioxide, helium, argon, nitrogen, liquids, etc., are commonly used to deliver energy in the form of pressure in a variety of industrial applications. The devices that use the pressurized fluid, known as load devices, include robots, paint applicators, turbines, power generators, jet engines, pneumatic tools, and others. Compressible fluids are typically pressurized using a compressor, which may take one of many forms, such as a centrifugal compressor, a reciprocating compressor, a rotary screw, a stack of alternating rotors and stators, or other forms.

A compressor takes in a compressible fluid at an inlet, uses energy to compress a mass of the compressible fluid to a smaller volume and higher pressure, then discharges the fluid thus compressed through an outlet. An individual compressor produces compressed fluid at a specified flow capacity, defined in terms of volume of free fluid at the inlet of the compressor per amount of time. The individual compressor also produces a selected discharge pressure at the outlet due to the normal operation of the compressor. The selected discharge pressure can typically be varied up to a specified maximum discharge pressure of which the compressor is capable.

The specified flow capacity and selected discharge pressure are chosen to suit the particular application for which the compressor is intended. For example, some typical compressors intended for an automobile manufacturing and assembly plant have selected discharge pressures in the general range of 95 to 125 pounds per square inch gage (PSIG), and a flow capacity in the range of 1,000 to 3,000 standard cubic feet per minute (SCFM). SCFM is defined as, "cubic feet of volume per minute at the standard conditions of 14.7 pounds per square inch absolute (psiA) and 60 degrees Fahrenheit." Many other ranges of discharge pressures and flow capacity are possible depending on the needs of the particular application.

Each load device in turn has a demand flow rate, which is the volume rate of fluid used by the load device in its operation. Each load device also has a specified incoming pressure that it requires for normal operation. Demand flow rate may be fairly constant or change frequently, depending on the application. Any load device is likely to drop its demand flow rate temporarily at least occasionally for interruptions such as maintenance, breaks, etc.

For facilities in which many load devices are operating, it is common to provide the required pressurized fluid to the load devices through a single fluid distribution system which services the load devices at its downstream outlets. The single distribution system can in turn be serviced by any number of compressors that supply pressurized fluid to the distribution system at the system's upstream inlets. This single distribution system provides greater flexibility than if each load device had to be serviced by its own compressor, acting to average-out any changes in demand flow rate.

However, total demand flow rate of a collection of load devices still tends to fluctuate during operation. The degree of fluctuation depends on the type and operational nature of the facility using the load devices. If too few compressors are operated, when the demand flow rate rises particularly high, it will surpass the flow rate from the compressors. This will lower the distribution pressure, disrupting the proper operation of the load devices.

To prevent disruptions of this sort, multiple compressor systems are generally designed and installed to cater to the maximum peak demand flow rate at the required load pressure. Facility operators tend to operate the maximum installed capacity of all compressors all the time at the maximum pressure, to ensure that the load devices receive enough pressure even during peaks in demand flow rate. So, the installed compressor discharge flow capacity is greater than it usually needs to be; and the compressors must be set to a higher discharge pressure than what the load devices require most of the time. Excessive compressor capacity and discharge pressure both translate into higher energy consumption, maintenance costs, and capital costs.

However, successful operation of the load devices is typically a greater priority than efficient operation of the compressors. The traditional multi-compressor system therefore sacrifices compressor system efficiency to prevent pressure shortages during times of peak demand flow rate.

A multiple compressor system is therefore desired in which the flow rate from the compressors is varied to match variations in demand flow rate, preferably without operating compressors at partial capacity. It is also desired to provide a multiple compressor system with improved efficiency, in which energy consumption, maintenance costs, and capital costs are reduced without reducing capacity to deliver sufficiently pressurized fluid to the load devices.

SUMMARY OF THE INVENTION

One embodiment of the present invention is directed to a multi-compressor system that includes a fluid distribution system, a base compressor set, a flow controller, a trim compressor set, and a trim volume. The multi-compressor system provides compressed fluid to a load device set. The load device set has a nominal demand flow rate and a maximum demand flow rate. The fluid distribution system is coupled to the load device set. The base compressor set is coupled to the fluid distribution system. The base compressor set has a maximum base discharge flow capacity that is less than the maximum peak demand flow rate by a maximum peak deficit flow rate. The flow controller has a downstream side coupled to the fluid distribution system, and an upstream side coupled to a trim compressor set. The trim compressor set has a maximum trim discharge flow capacity that is at least as great as the maximum peak deficit flow rate. The trim volume is coupled between the outlet of the trim compressor set and the upstream side of the flow controller.

Another embodiment of the present invention is directed to a method of operating a multi-compressor system. The method includes supplying pressurized fluid at a base discharge pressure from a base compressor to a fluid distribution system and supplying pressurized fluid at a trim discharge pressure from a trim compressor to a trim volume.

The trim compressor supplies the pressurized fluid to the trim volume as a function of a rate of change of mass of the pressurized fluid in the trim volume. The trim volume includes a receiver, and the trim discharge pressure is greater than the base discharge pressure. A flow controller is operated to control flow of pressurized fluid from the trim volume to the fluid distribution system.

Yet another embodiment of the present invention is directed to a multi-compressor system, which includes a fluid distribution system, a base compressor, a trim compressor, a receiver, a flow controller and a control device. The base compressor is coupled to the fluid distribution system. The flow controller has an upstream side coupled to the trim compressor and a downstream side coupled to the fluid distribution system. The fluid receiver is coupled to the trim compressor and the upstream side of the flow controller for storing pressurized fluid. The control device is coupled to the trim compressor for controlling the trim compressor as a function of a rate-of-change of mass of the pressurized fluid stored in the receiver.

DETAILED DESCRIPTION OF THE PREFERRED EMBODIMENTS

Figure 1:
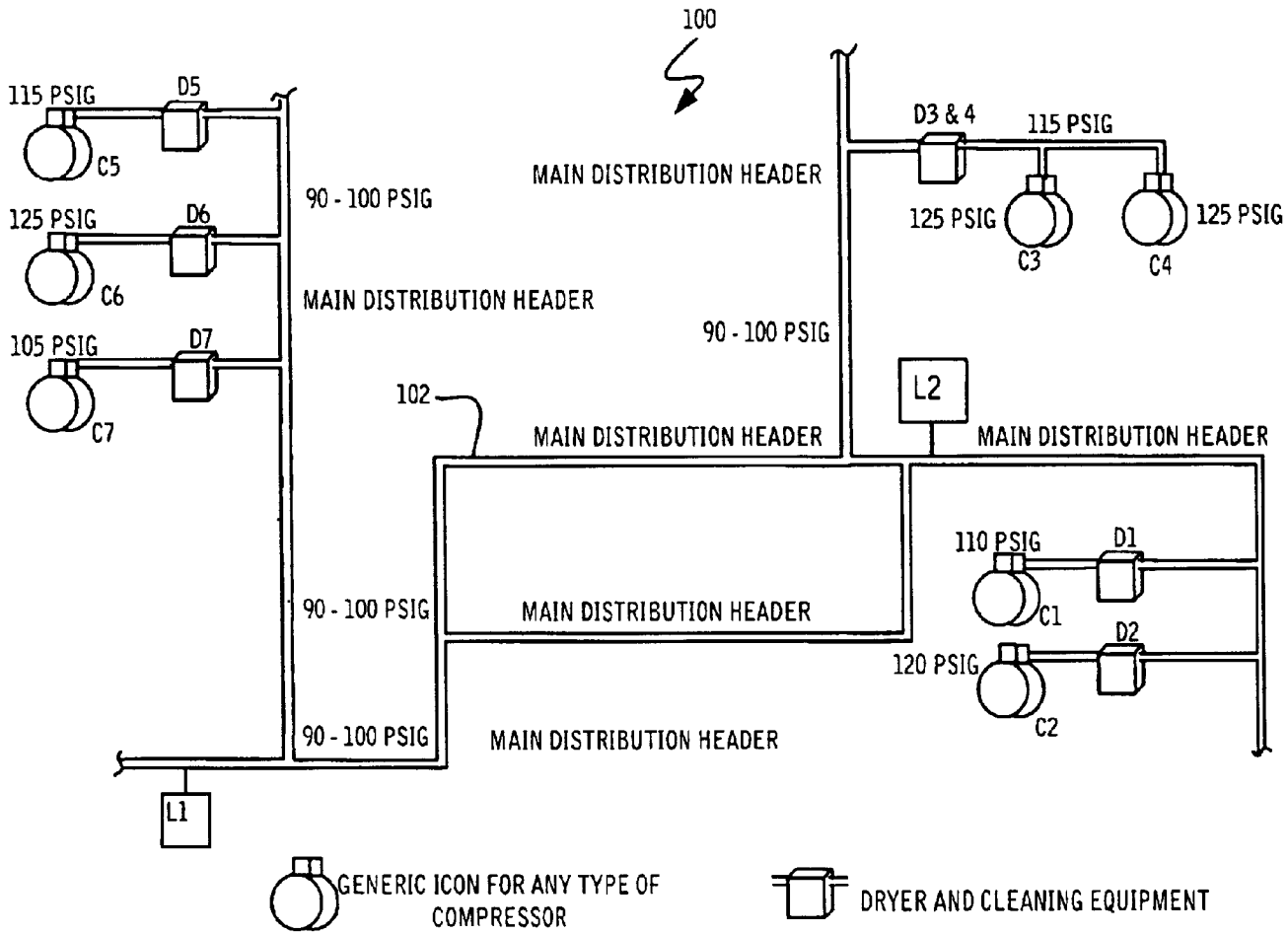
Fig. 1 (PRIOR ART)
FIG. 1 is a block diagram of a multiple-compressor system of the prior art.

FIG. 1 is a schematic diagram illustrating an example of a multiple-compressor system 100 according to the prior art. In the example shown in FIG. 1, multiple-compressor system 100 is a compressed air system within an automobile manufacturing facility, where the fluid that is compressed is atmospheric air. The facility uses compressed air as energy for operating robots, painting equipment, cylinders and numerous other pneumatic tools.

Multiple-compressor system 100 includes a plurality of individual compressors C1–C7, which are coupled to a main fluid distribution header 102 through dryer and filter devices D1–D7, respectively. Compressors C1–C7 can be located in one or more areas of the facility. Compressors C1–C7 take atmospheric air in through an inlet, compress the air to a higher pressure and discharge the compressed air through an outlet. The energy for increasing the pressure of the fluid medium can be derived from one or more prime movers, which drive a shaft of each respective compressor. Each compressor has a specified flow capacity and a specified maximum discharge pressure. The discharge pressures of compressors C1–C7 are typically adjustable within some range up to the specified maximum discharge pressure. FIG. 1 shows an example of the discharge pressure settings for compressors C1–C7. For example, compressor C5 is set to produce a discharge pressure of 115 pounds per square inch gage (PSIG). Gage pressure is the amount by which the total absolute pressure exceeds the ambient atmospheric pressure.

The outlets of compressors C1–C7 are coupled to the inlets of dryer and filter devices D1–D7, respectively. Dryer and filter devices D1–D7 remove moisture, dust and other contaminating particles from the compressed air such that dry, clean air is delivered to main distribution header 102.

Main distribution header 102 is interconnected by welding or other suitable means of fastening, with or without functioning or non-functioning isolating valves. For example, main distribution header 102 can include a combination of 4inch to 12-inch diameter pipe.

Load devices, such as L1 and L2, can be coupled to outlets along main distribution header 102. As mentioned above load devices L1 and L2 can include robots, painting equipment, cylinders and pneumatic tools, for example. Load devices L1 and L2 each have a demand flow rate, which is a volume rate of fluid (air in this embodiment) used by the load device during its operation. Load devices L1 and L2 typically also have a preferred incoming pressure that is required for normal operation. In the example shown in FIG. 1, load devices L1 and L2 require about 90 PSIG pressure.

The total demand flow rate on main distribution header 102 may be fairly constant or may change frequently, depending on the needs of system 100. Therefore, multiple-compressor systems of the prior art such as that shown in FIG. 1 are generally designed and installed to cater to the maximum peak demand flow rate at the required pressure. If enough of compressors C1–C7 are not running when demand by load devices L1 and L2 increases, the outflow from the system will exceed the inflow to the system causing the density of air in the system and the resulting air pressure to decrease. The decrease in pressure can then cause a disruption in production within the facility. Excessive pressure drops in the system can also be caused by undersized cleaning equipment and piping and dirt accumulated in the system, for example.

In order to avoid pressure drops during periods of fluctuating demand, facility operators tend to operate multiple-compressor systems such that all compressors in the system provide the maximum installed flow capacity and the maximum discharge pressure all of the time. With this type of operation, the average demand flow rate is always less than the installed discharge flow capacity. Therefore, compressors C1–C7 are forced to run at "partial loads". Partial load is defined by the demand flow rate (SCFM) divided by the discharge flow capacity (SCFM). A compressor is under a partial load when the compressor is capable of supplying a higher flow rate, at the selected discharge pressure, than the demand flow rate.

At partial loads, efficiency of system 100 decreases. Efficiency can be defined as "average SCFM of compressed air/average kW consumed," where SCFM is the cubic feet of air volume per minute at the inlet of each compressor and kW is the rate of energy consumed, in kilowatts, by the prime mover of the compressor. Efficiency of the total system can then be defined in terms of "total average SCFM of compressed air/total average kW consumed" in system 100.

As a general rule, for every two PSIG increase in discharge pressure of any positive displacement compressor, the energy consumption will increase by one percentage point. Similarly, for every two PSIG decrease in discharge pressure of any positive displacement compressor, the energy consumption will decrease by one percentage point. Therefore a compressor running at 10 PSIG greater than the required pressure consumes approximately 5% more energy than necessary.

Table 1 provides a list of hypothetical properties for compressors C1–C7 according to an example in which system 100 uses air for 8,400 hours per year and maintains around 90 PSIG in the main distribution header. These properties include for each compressor the type, model and make, the designed maximum discharge pressure, the flow capacity (SCFM), the rated energy consumed by the prime mover (kW), the maximum efficiency (SCFM/kW), and a hypothetical measured SCFM, kW and SCFM/kW.

TABLE 1

Specifications for Sample Multi-Compressor System:

| Compsr. ID: | Type: | Model: | Make: | Maximum Discharge Pressure: | Specified Flow Capacity: | Maximum Power Consumed: |
|---|---|---|---|---|---|---|
| C1 | Rotary | A Corp. | W | 125 PSIG | 1,500 SCFM | 250 kW |
| C2 | Rotary | A Corp. | X | 125 PSIG | 1,000 SCFM | 185 kW |
| C3 | Reciproc. | B Corp. | Y | 125 PSIG | 1,200 SCFM | 225 kW |
| C4 | Reciproc. | B Corp. | Y | 125 PSIG | 1,200 SCFM | 225 kW |
| C5 | Centrifuge | C Corp. | Z | 115 PSIG | 2,800 SCFM | 450 kW |
| C6 | Rotary | A Corp. | W | 125 PSIG | 1,500 SCFM | 250 kW |
| C7 | Centrifuge | C Corp. | Z | 115 PSIG | 2,800 SCFM | 450 kW |
| Total: | | | | | 10,800 SCFM | 1,810 kW |

Specifications for System 100 in operation:

| Compsr. ID: | Selected Discharge Pressure: | Actual Flow: | Actual Power Consumption: | Potential Efficiency (SCFM/kW): | Actual Efficiency (SCFM/kW): |
|---|---|---|---|---|---|
| C1 | 125 PSIG | 1,275 SCFM | 237.5 kW | 6.00 | 5.37 |
| C2 | 125 PSIG | 500 SCFM | 157.3 kW | 5.41 | 3.18 |
| C3 | 125 PSIG | 1,200 SCFM | 225.0 kW | 5.33 | 5.33 |
| C4 | 125 PSIG | 0 SCFM | 0 kW | 5.33 | n/a |
| C5 | 115 PSIG | 1,680 SCFM | 382.5 kW | 6.22 | 4.39 |
| C6 | 125 PSIG | 750 SCFM | 212.5 kW | 6.00 | 3.53 |
| C7 | 115 PSIG | 1,680 SCFM | 382.5 kW | 6.22 | 4.39 |
| Total: | | 7,085 SCFM | 1,597 kW | 5.97 | 4.44 |

Table 2 lists each dryer and filter device D1–D7 in FIG. 1, its flow capacity (SCFM), the dryer type, the filter type, and the corresponding compressor identification (ID).

TABLE 2

Specifications for Dryer/Filter Devices:

| Dryer/Filter ID: | Flow Rate Capacity of Dryer: | Dryer Type: | Filter Type: | Dedicated for Compressor: |
|---|---|---|---|---|
| D1 | 1,500 SCFM | Refrigerant | Coalescent | C1 |
| D2 | 1,000 SCFM | Refrigerant | Coalescent | C2 |
| D3 | 1,200 SCFM | Refrigerant | Coalescent | C3 |
| D4 | 1,200 SCFM | Refrigerant | Coalescent | C4 |
| D5 | 2,800 SCFM | Refrigerant | Coalescent | C5 |
| D6 | 1,500 SCFM | Refrigerant | Coalescent | C6 |
| D7 | 2,800 SCFM | Refrigerant | Coalescent | C7 |

As illustrated in Table 1, all compressors except compressor C3 perform at partial load and therefore at a lower than maximum efficiency. Compressor C4 is shown in standby mode. One of the primary causes for the lower efficiency is that the supply rate is more than the demand rate.

Table 3 summarizes the system efficiency of multiple-compressor system 100, shown in FIG. 1.

TABLE 3

SYSTEM 100 EFFICIENCY

| | |
|---|---|
| Installed Flow Capacity and Pressure: | 10,800 SCFM @ 115–125 PSIG |
| Average Demand Flow Rate and Pressure: | 7,085 SCFM @ 90 PSIG |
| Compression Flow Demand/Supply Ratio: | 65.6% |
| Average Power Consumption: | 1,597 kW |
| Flow/Power Efficiency Ratio: | 4.44 SCFM/kW |

The compressors in system 100 are partially loaded at an average of 65.6 percent of their flow capacity and have an average total efficiency of only 4.44 SCFM/kW.

Figure 2:
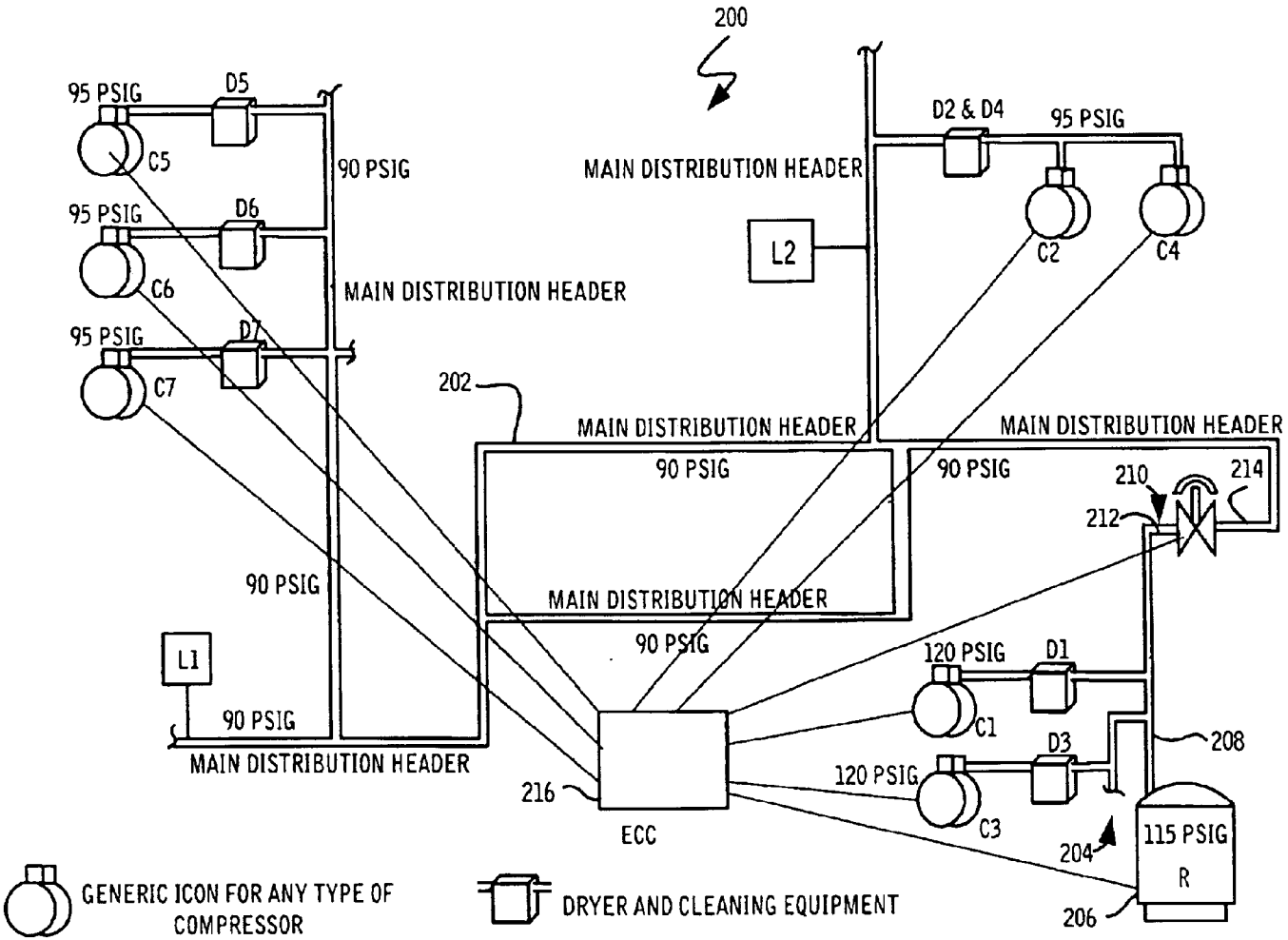
FIG. 2 is schematic diagram of a multiple-compressor system according to one embodiment of the present invention.

FIG. 2 is a schematic diagram illustrating a multiple-compressor system 200 according to one embodiment of the present invention, which is capable of achieving a higher efficiency than the system shown in FIG. 1. FIG. 2 is schematic only and not drawn to any scale. Similar to the system shown in FIG. 1, system 200 includes a plurality of compressors C1–C7, a plurality of respective drying and filter devices D1–D7, a main distribution header 202, and one or more load devices L1 and L2.

Compressors C1–C7 are coupled to main fluid distribution header 202 through optional dryer and filter devices D1–D7, respectively. Compressors C1–C7 can be located in one or more areas of the facility, and any number of compressors can be used. Compressors C1–C7 can include any combination of types, makes or models of compressors. For example, compressors C1–C7 can include reciprocating, rotary screw, centrifugal, scroll and vane type compressors. Each compressor has a specified flow capacity and a specified maximum discharge pressure. The discharge pressures of compressors C1–C7 are adjustable within some range up to the specified maximum discharge pressure. In an alternative embodiment, one or more of the compressors C1–C7 have a fixed discharge pressure, and that discharge pressure is selected for the particular application in which the compressor is used. The prime movers for compressors C1–C7 can be driven by electricity, fossil or other fuels, or steam, for example.

The outlets of compressors C1–C7 are coupled to the inlets of dryer and filter devices D1–D7, respectively. Dryer and filter devices D1–D7 remove moisture, dust and other impurities from the compressed air such that dry, clean air is delivered to main distribution header 202. In an alternative embodiment, one or more of the devices D1–D7 can be located in other positions in system 200, such as on the inlet side of its respective compressor. Also, one device D1–D7 can be used to dry and filter air from more than one compressor.

Main distribution header 202 can include a pipe or a series of pipes or other functionally analogous fluid conductors that are capable of conveying pressurized fluid to at least one outlet, such as to load devices L1 and L2. The fluid conductors can be interconnected by welding or other suitable means of fastening, with or without functioning or non-functioning isolating valves. In one embodiment, main distribution header 202 includes a combination of 4-inch to 8-inch diameter pipe. Other sizes of pipes can also be used.

Load devices L1 and L2 can include any type or combination of load devices, such as robots, painting equipment, cylinders and pneumatic tools, for example. Load devices L1 and L2 each have a demand flow rate, which is a volume rate of fluid (air in this embodiment) used by the load device during its operation. Load devices L1 and L2 also have a preferred incoming pressure that is desired for normal operation. In the example shown in FIG. 2, load devices L1 and L2 require about 90 PSIG in main distribution header 202 for normal operation.

Compressors C2 and C4–C7 are coupled to main distribution header 202 as a base compressor set, while compressors C1 and C3 are coupled as a trim compressor set within a trim station 204. A base or trim compressor set may include one or any other number of compressors in alternative embodiments. Compressors C2 and C4–C7 are selected to run such that they provide the greatest possible share of the discharge flow during periods of nominal demand flow rate, such as the average demand flow rate, without running any base load compressors at partial loads. The base load compressor set therefore has a maximum discharge flow capacity that is less than the demand flow rate during peaks in demand, at least including the maximum peak. The difference between the maximum base discharge flow capacity and the actual demand flow rate during a peak in demand is a peak deficit flow rate. The peak deficit flow rate reaches its maximum when demand flow rate hits its maximum peak.

Trim station 204 is isolated from main distribution header 202 by a flow controller 210 and includes trim compressors C1 and C3, dryer and filter device D3, trim storage receiver 206, and a trim header 208. Trim compressors C1 and C3, receiver 206 and flow controller 210 are selected to run such that trim compressors C1 and C3 and receiver 206 provide the deficit flow rate to main distribution header 202 to maintain the desired pressure in the main distribution header. Any number of trim receivers can be used in alternative embodiments of the present invention. Receiver 206 can include any type of receiver that is capable of storing compressed fluid.

Flow controller 210 has an upstream side 212 and a downstream side 214. Upstream side 212 is coupled to trim distribution header 208, while downstream side 214 is coupled to main distribution header 202. In one embodiment, flow controller 210 is a self-acting flow controller having a downstream or "base" side pressure sensor. Flow controller 210 modulates the flow from upstream side 212 to downstream side 214 as a function of the base side pressure to maintain a desired pressure in main distribution header 202. The desired downstream pressure setting can be fixed or variable. Other types of flow controllers can also be used. The upstream side of flow controller 210 is coupled to trim header 208, which is coupled to the outlets of dryer and filter device D3 and receiver 206. The total volume defined by the receivers and associated piping that couples the receivers, the trim compressor set, and the upstream side of the flow controller is the trim volume.

As described in more detail below, an electronic controller 216 is coupled to compressors C1–C7, trim storage receiver 206 and flow controller 208 for controlling the operation of multiple-compressor system 200. Electronic controller 216 can be configured to control system 200 in a closed-loop control fashion or an open-loop control fashion. One or more sensors (not shown) can be distributed throughout system 200 as desired for providing electronic controller 216 with appropriate measurements from various locations within the systems. For example, these sensors can include pressure sensors, temperature sensors and mass flow sensors.

Electronic controller 216 can include any control device such as a programmable logic controller (PLC), a microprocessor-based controller, or a personal computer-based controller. Electronic controller 216 can be a digital-based or analog-based controller. In alternative embodiments, electronic controller 216 can be replaced with a plurality of individual controllers, wherein each controller controls one or more of the components within system 200. In addition, electronic controller 216 can be replaced with a manual-type control, a different electrical-type control or a combination of both.

If the demand flow rate on main header 202 increases due to an increase in compressed fluid consumption, the pressure within header 202 will start to decrease. This pressure drop will be sensed by flow controller 210 either directly or through pressure sensors monitored by electronic controller 216. If the pressure drops below the desired set point pressure by a sufficient amount, such as 2 PSIG, flow controller 210 increases flow to main distribution header 202 from trim station 204 to maintain the desired pressure within the main distribution header. This additional flow is supplied by the compressed air mass stored in receiver 206.

If the amount of air stored in receiver 206 is not sufficient to satisfy the increase in demand, electronic controller 216 may start and load one or more of the trim compressors C1 and C3. Depending on the rate at which the mass is drawn out of receiver 206 and the length of time during which air is withdrawn, trim compressors C1 and/or C3 may be needed to re-establish the compressed air mass in receiver 206. Once the mass of air in receiver 206 is re-established, trim compressors C1 and C3 can then be returned to the standby mode. If the capacity of trim compressors C1 and C3 is insufficient to cover the additional demand, then electronic controller 216 may start and load one or more additional trim compressors (not shown in FIG. 2) and/or one or more additional base load compressors, such as C4 and C6.

These decisions can be based on one or more of the following factors, such as the pressure in main distribution header 202 (base pressure), the pressure in receiver 206 (trim pressure), the rate of change of the base and/or trim pressures, the rate of change of mass in the base side and/or trim side, the mass flow rates in the base and trim sides and the ambient temperature of system 200. Other factors can also be used. In one illustrative embodiment these decisions are based on the base pressure, the trim pressure and the rate of change of mass in receiver 206. In this embodiment, there is no need to measure flow rates in the system.

By isolating trim compressors C1 and C3 and trim receiver 206 from the base load compressors C2 and C4–C7, system 200 can operate to provide a stable pressure within main distribution header 202 at the required flow capacity while consuming less energy for compression. This energy savings and resulting efficiency improvement can be illustrated through the following example. The particular operating parameters and system specifications are provided as examples only and are not intended to be limiting.

In this example, system 200 requires an average volume 7,085 SCFM of compressed air to be delivered to main distribution header 202 at 90 PSIG. Table 4 provides a list of hypothetical specifications for compressors C1–C7 according to the example.

TABLE 4

Specifications for an Embodiment of the Present Invention:

| Compressor ID: | Selected Discharge Pressure: | Actual Flow: | Actual Power Consumed: | Potential Efficiency (SCFM/kW): | Actual Efficiency (SCFM/kW): |
|---|---|---|---|---|---|
| C1 (Trim) | 120 PSIG | 0 SCFM | 0 kW | 5.33 | n/a |
| C2 (Base) | 95 PSIG | 1,000 SCFM | 157.3 kW | 5.41 | 5.41 |
| C3 (Trim) | 120 PSIG | 540 SCFM | 225.0 kW | 5.33 | 4.80 |
| C4 (Base) | 95 PSIG | 0 SCFM | 0 kW | 5.33 | n/a |
| C5 (Base) | 95 PSIG | 2,800 SCFM | 382.5 kW | 6.22 | 6.22 |
| C6 (Base) | 95 PSIG | 0 SCFM | 0 kW | 6.00 | n/a |
| C7 (Base) | 95 PSIG | 2,800 SCFM | 382.5 kW | 6.22 | 6.22 |
| Total: | | 7,140 SCFM | 1,198 kW | 5.97 | 5.96 |

Given the flow capacities of each compressor and their efficiencies, the minimum number of base load compressors, such as C2, C5 and C7, are selected to run in an active mode for providing a majority (base load) of the compressed air flow required on average by the facility. These compressors are set to provide the minimum discharge pressure that is practically acceptable for the proper operation of the load devices.

For example, if dryer and filter devices D2 and D4–D7 tend to create a pressure drop of up to 5 PSIG between the inlets and the outlets of the devices, then compressors C2, C5 and C7 will be set to run to compress a total of 6,600 SCFM to 95 PSIG (providing a 5 PSIG allowance for pressure loss in D2, D5 and D7). Compressors C4 and C6 are placed in standby mode. In the example shown in Table 4, compressor C2 has a discharge flow capacity of 1,000 SCFM, and compressors C5 and C7 each have a discharge flow capacity of 2,800 SCFM. Receiver 206 has a volume of 5,000 gallons. Receivers having other volumes can also be used.

System 200 therefore requires a balance (trim flow) of 485 SCFM at 90 PSIG that is supplied by trim station 204. Trim compressor C3 is set to provide a discharge pressure that is higher than the discharge pressures of base load compressors C2, and C4–C7. For example, trim compressor C3 is set to provide a discharge pressure of 120 PSIG.

Flow controller 210 regulates an average flow of 485 SCFM to main distribution header 202, thereby fulfilling the remainder of the system requirement. Flow controller 210 maintains the compressed air mass that is stored in its upstream side within trim distribution header 208 and trim storage receiver 206.

Looking at Table 4, since compressors C2, C5 and C7 operate at their maximum flow rates, these compressors have larger SCFM/kW efficiencies than similar compressors in the prior system shown in Table 1.

Table 5 summarizes the overall efficiency of system 200, which can be compared to the efficiency of system 100, as shown in Table 3.

TABLE 5

SYSTEM 200 EFFICIENCY

| | |
|---|---|
| Active Flow Capacity and Pressure: | 7,800 SCFM @ 95 PSIG |
| Average Demand Flow Rate and Pressure: | 7,085 SCFM @ 90 PSIG |
| Compression Flow Demand/Supply Ratio: | 90.8% |
| Average Power Consumption: | 1,198 kW |
| Flow/Power Efficiency Ratio: | 5.96 SCFM/kW |

The compressors in system 200 that provide the base flow are more completely loaded at 90.8 percent, as compared to 65.6 percent for system 100. The average electric demand of system 200 is also lower at 1,198 kW as compared to 1,597 kW for system 100. The average total efficiency of system 200 therefore is greater at 5.96 SCFM/kW as compared to 4.44 SCFM/kW for system 100.

As a result, multiple-compressor system 200 had a projected power consumption savings of approximately 400 kW, maintained three compressors in the standby mode and was capable of maintaining pressure fluctuation within the main distribution header of +/−2 PSIG to the desired pressure in the header.

With the system shown in FIG. 2, if the demand on compressed air suddenly increases, receiver 206 and flow controller 210 allow trim station 204 to satisfy the sudden increase in demand. This increase in demand can be satisfied for a time period that is sufficient to allow one or more of trim compressors C1 and C3 to come on-line, load and compress additional fluid as needed without allowing a drop in the operating pressure within main distribution header 202.

Isolating the trim compressor(s) and the trim receiver from the base load compressors allows the base load compressors to be operated at minimum pressures, while requiring only the trim compressor(s) to be operated at elevated pressures. This results in much lower energy consumption by the system. This arrangement also allows a much smaller and less expensive receiver to be used than in a traditional system.

Storage receivers have been used in some prior art multiple-compressor systems. However these receivers may not have been isolated from the compressors by a flow controller. Even in a system where a flow controller isolates the supply side (compressors, cleaning equipment, etc.) and the demand side (distribution system), the receiver is coupled in parallel with all the compressors on the upstream, supply side of the flow controller. The downstream side of the flow controller is coupled to the main distribution header. While such a configuration can provide for improved efficiency, the capacity of the storage receiver and the size of the flow controller must be designed to satisfy the net total capacity of the entire system.

In contrast, the multiple control system of the embodiment shown in FIG. 2 requires the capacity of storage receiver 206 and the size of flow controller 210 to be based only on the net total discharge flow capacity of trim station 204. For example, in a multiple-compressor system of the prior art having a system capacity of 7,000 SCFM under standard conditions (14.7 PSIA at 60 degrees Fahrenheit), the flow controller would require a flow capacity of 7,000 SCFM and a receiver volume of 21,000 gallons, for example. In one example of the system shown in FIG. 2, if the total system capacity were 7,000 SCFM, flow controller 210 requires a flow capacity of only 1,000 SCFM and a receiver volume of only 5,000 gallons, for example.

Figure 3:
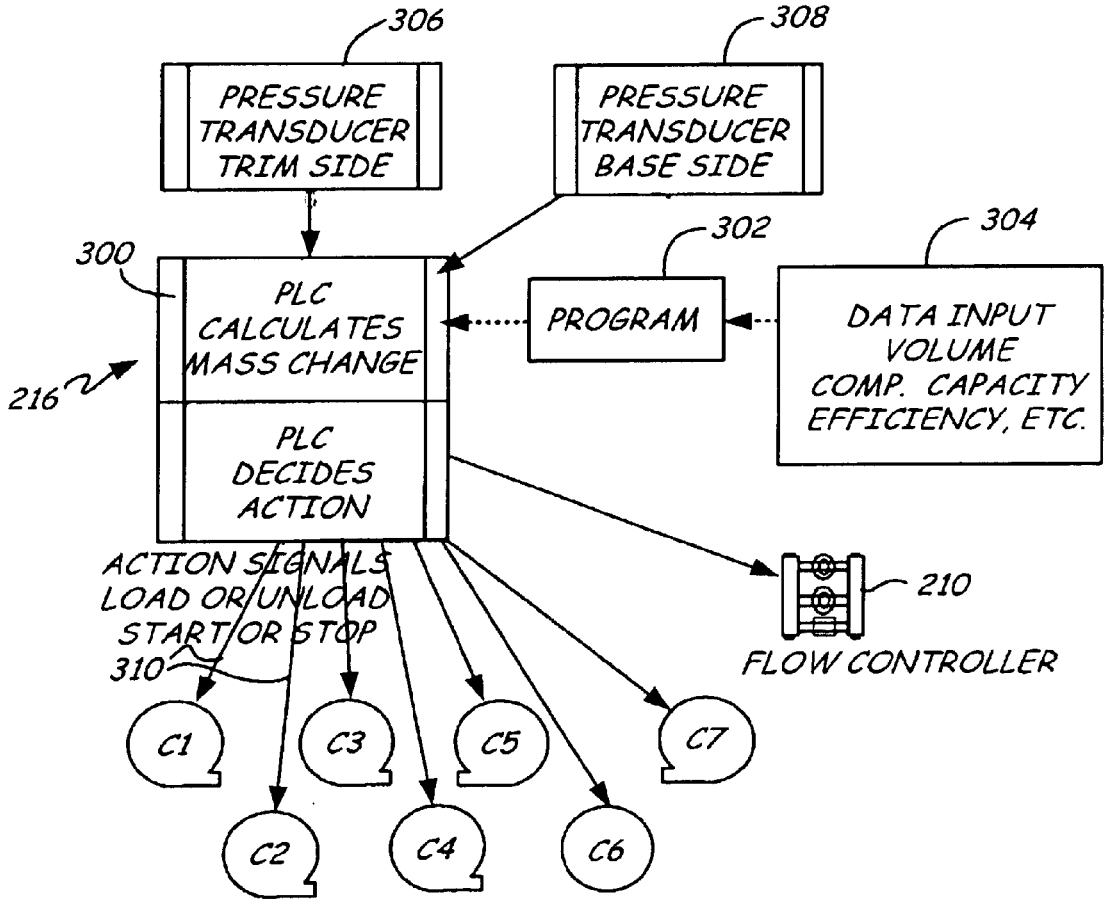
FIG. 3 is a block diagram of an electronic controller for controlling the multiple-compressor system shown in FIG. 2, according to one embodiment of the present invention.

FIG. 3 is a block diagram illustrating a control function of electronic control 216 in greater detail. In one embodiment of the present invention, electronic control 216 includes a programmable logic controller (PLC) 300 having a program 302 and a database 304. Program 302 is tailored to perform the desired control function for the multiple-compressor system based on data stored in database 304 and input parameters received from trim side pressure sensor 306 and base side pressure sensor 308, for example. A temperature sensor (not shown) can also be used to measure the temperature of the system. Program 302 can be implemented in software, hardware or a combination of both.

Database 304 includes system-specific data, such as the specifications of each component in the system. These specifications can include the maximum discharge pressure, the selected discharge pressure, the maximum discharge flow capacity and the rated energy consumption of each compressor, the pressure consumption of each drying and filter device, the flow capacity of each dryer and filter device, the total system flow capacity, the "base volume" of the main distribution header, the "trim volume" of the trim side, the capacity of receiver 206, the flow settings and capacity of flow controller 210, the desired base pressure, and the desired trim pressure, for example. Other data can also be stored in database 304 as necessary. Database 304 can be stored in any suitable computer readable medium, such as a random access memory (RAM), a floppy disc, a disc drive, a CD-ROM, a compact-flash card or a local or remote computer server.

Pressure transducer 306 is mounted to sense the pressure on the trim side of flow controller 210, such as along trim distribution header 208 or within receiver 206. Any suitable pressure transducer can be used. Similarly, pressure transducer 308 is coupled to sense pressure on the base side of flow controller 210. For example, pressure transducer 308 can be coupled along main distribution header 202.

PLC 300 receives measurements of the trim-side pressure and base-side pressure from transducers 306 and 308 and calculates the dynamic rate-of-change of mass of the air stored in receiver 206 and of the air within main distribution header 202. Based on the mass change calculations, PLC 300 decides an appropriate action in order to maintain a stable pressure within the main distribution header. For example, PLC 300 can actuate flow controller 210, load or unload one or more of compressors C1–C7, and start or stop one or more of the compressor C1–C7, as indicated by arrows 310.

Alternatively, PLC 300 can base its decisions on the rate of change of pressure in the trim and base sides, for example. Also, pressure transducers 306 and 308 can be replaced with mass flow meters, which provide PLC 300 with flow rates at various locations within the multiple-compressor system. Other types of sensors or transducers can also be used.

Figure 4:
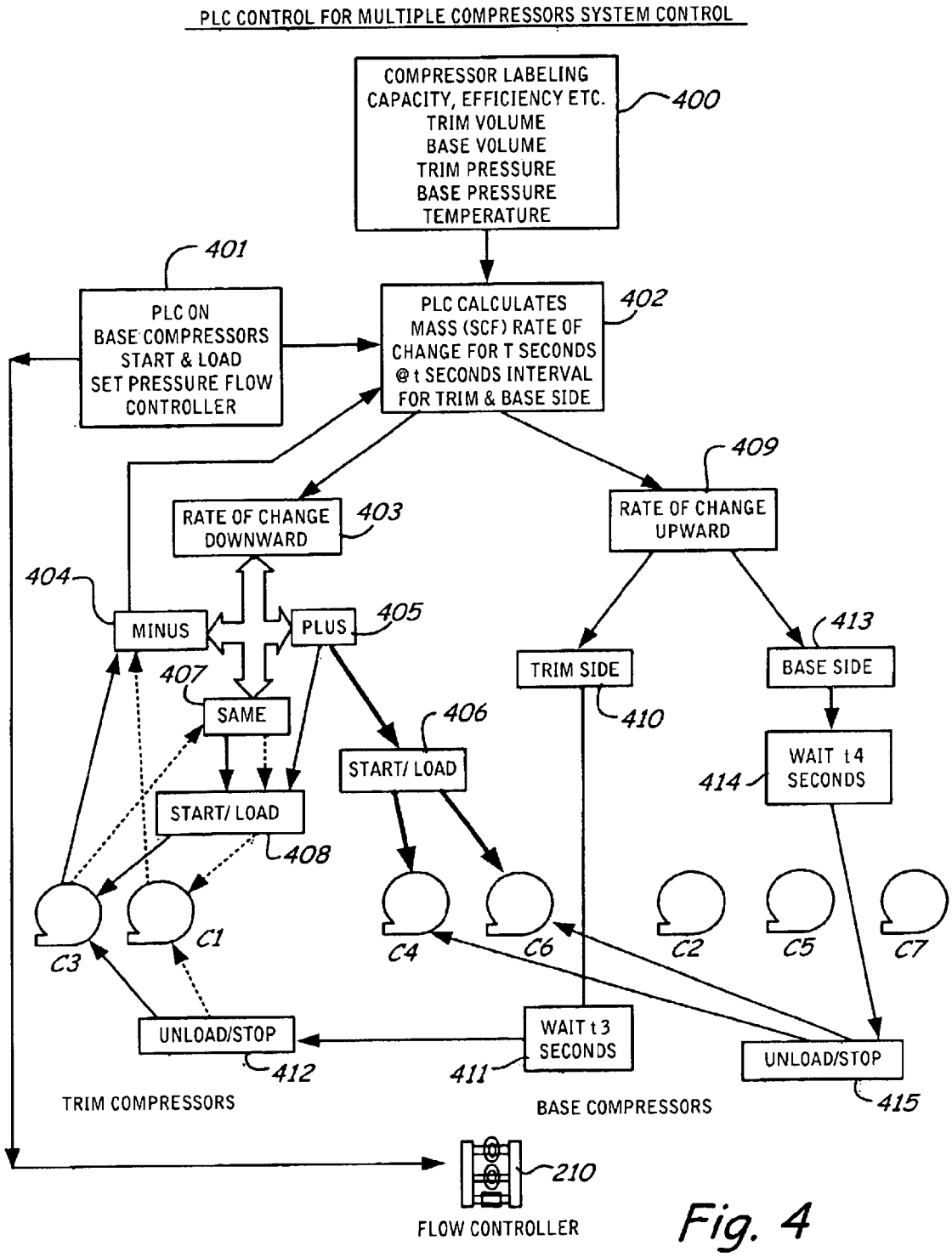
FIG. 4 is a flowchart of a routine used by the electronic controller for controlling the multiple-compressor system shown in FIG. 2, according to one embodiment of the present invention.

FIG. 4 is a flowchart illustrating the steps performed by PLC 300 in controlling the various components within multiple-compressor system 200 according to one embodiment of the present invention.

At step 400 data is provided to the PLC from database 304 (shown in FIG. 3) and from the various sensors in the system. At step 401 the system is turned on and initialized. The PLC is powered-up and selects the desired base compressors to be started and loaded. PLC 300 sets flow controller 210 to maintain a specified downstream pressure. Step 401 can be performed at the start of each work day in a facility or at less frequent times if the facility operates 24 hours per day.

At step 402, the PLC calculates the mass rates of change on the trim side and base side of flow controller 210. This calculation is based on inputs to the PLC from sensors, transducers, an internal memory storage, a network-hosted database, or other input sources. The inputs represent values for trim side air pressure, base side air pressure, volume, and trim side air density. In one example, a method of calculating air density is used wherein a standard air density under arbitrarily chosen conditions forms a basis value, which is subjected to correction terms such as temperature and pressure to reach an accurate value for local conditions. A calculation of air mass in the trim side can therefore take the form of:

$$M_t=(D_s*V_t)/[(Pa*(T+460))/((Pa+P_t)*(T_s+460))]$$

where $M_t$ is the mass of air in the trim volume (receiver 206 and trim side piping), $D_s$ is a standard air density at standard conditions of temperature and pressure, $V_t$ is the trim volume, which is the volume of the trim side including the receiver, T is the measured temperature of the air in degrees Fahrenheit, $T_s$ is standard air temperature in degrees Fahrenheit, Pa is the standard ambient pressure in psiA, and $P_t$ is the trim side pressure in psiG. The term of 460 added to both temperatures sets them to an absolute scale by compensating for absolute zero being 460 degrees below zero in the Fahrenheit scale. Obviously, details of the equation would change in other embodiments, such as if temperature were measured in the Kelvin or Celsius scale, or if additional corrective terms were included, according to well-known methods of calculating a mass based on values of pressure, volume, density, etc. In an alternative embodiment, the rate of change in mass is calculated for the receiver only. In this embodiment, $V_t$ represents the receiver volume.

A similar calculation can be used for calculating the mass in the base side:

$$M_b=(D_s*V_b)/[(Pa*(T+460))/((Pa+P_b)*(T_s+460))]$$

where $M_t$ is the mass of air in the base side, $D_s$ is a standard air density at standard conditions of temperature and pressure, $V_b$ is the trim volume, T is the measured temperature of the air in degrees Fahrenheit, $T_s$ is standard air temperature, Pa is the standard ambient pressure in psiA, and $P_b$ is the base side pressure in psiG. Again, details of the equation would change in other embodiments, such as if temperature were measured in the Kelvin or Celsius scale, or if additional corrective terms were included, according to well-known methods of calculating a mass based on values of pressure, volume, density, etc.

The rate of change of mass is calculated for a time period of t1 seconds, at intervals of t2 seconds. For example, if t1=30 seconds and t2=5 seconds, the PLC would calculate six samples of the mass rate of change over a 30 second time period.

If the mass rates of change on the trim side indicates the pressure in receiver 206 is dropping, the PLC moves to step 403 to determine the action needed to maintain sufficient pressure in the system to satisfy the increase in demand. The successive mass rates of change calculated in step 402 indicate whether the rate at which air is being withdrawn is decreasing, increasing or remaining constant. If the rate is decreasing, the PLC moves to step 404. The existing mass stored in receiver 206 is sufficient to supply the increase in demand on the base side of the system, and there is no need to start and load any additional compressors. The PLC therefore returns to step 402 for further mass rate of change calculations.

If the rate of change is increasing, as indicated by step 405, the PLC proceeds to steps 406 and 408 to start and load one or more trim and/or base load compressors to maintain sufficient pressure in the base and trim sides of the system. Based on the data provided at step 400 and the mass rate of change calculations, the PLC knows the amount of air in receiver 206 and the rate at which the air is being withdrawn from the receiver. Based on the capacities of the trim compressor and the standby base load compressors, the PLC determines which compressors need to be started and loaded and at which times to ensure that there will be no drop in pressure within main distribution header 202.

In one embodiment trim compressor C3 (and/or other additional trim compressors in the system such as C1) would be loaded first. If this additional capacity would not be sufficient to maintain the system pressure, one or more of the base load compressors, such as compressors C4 and C6 would be loaded.

If the rate of change of mass in receiver 206 is constant, as indicated by step 407, one or more trim compressors, such as trim compressor C3 will need to be started, as indicated by step 408. Again, the time at which trim compressor C3 must be loaded depends on the amount of air in receiver 206, the rate of change of mass being drawn from the receiver and the volume of the receiver.

Once one or more of the trim compressors and/or base compressors have been loaded, the rates of change of mass on the base and trim sides will begin to decrease. As subsequent calculations are performed at step 402, the PLC will proceed through steps 403 and 404 and back to step 402. At some point in time, the pressures in the base and trim sides of the system will begin to increase resulting in an upward rate of change. The PLC then proceeds to step 409. If the trim side pressure is increasing, at step 410, the PLC waits t3 seconds, at step 411, before unloading and subsequently turning the motor off of one or more of the trim compressors at step 412. The value of "t3" is based on the rate of change of mass, the volume of the trim side of the system and the desired pressure within receiver 206.

If the pressure is increasing on the base side of the system as indicated by step 413, the PLC waits for "t4" seconds, at step 414 and unloads and subsequently turns off the motor(s) of one or more of the base compressors, at step 415. Again, the value of time "t4" depends on the volume of the base side of the system, the mass rate of change on the base side, and the capacities of the base load compressors being unloaded. Other factors can be taken into consideration as well.

The particular steps taken by the PLC to maintain pressure within the main distribution header are provided as example only. Numerous modifications can be made in alternative embodiments of the present invention. Further, representations of the mass rate of change can be calculated in a number of ways. For example, the PLC can calculate the rate of change of mass or pressure.

In summary, the multiple-compressor control system of the present invention provides an economically feasible, much less expensive and practical solution to the problem of improving operating efficiency of the system as indicated by the "total average compressed SCFM/total average kW consumed." This translates to reduction in the energy consumed by the system, the cost of components used in the system, maintenance expenses and other ancillary costs. The system also provides a stable pressure within a close tolerance to the desired pressure in the plant header. A stable pressure reduces production disruption and increases productivity.

Although the present invention has been described with reference to preferred embodiments, workers skilled in the art will recognize that changes may be made in form and detail without departing from the spirit and scope of the invention.

What is claimed is:

1. A multi-compressor system for providing compressed fluid to a load device set having a nominal demand flow rate and a maximum peak demand flow rate, the multi-compressor system comprising:

a fluid distribution system coupled to the load device set;

a base compressor set coupled to the fluid distribution system, and having a maximum base discharge flow capacity that is less than the maximum peak demand flow rate by a maximum peak deficit flow rate;

a flow controller having a downstream side coupled to the fluid distribution system, and having an upstream side;

a trim compressor set coupled to the upstream side of the flow controller, and having a maximum trim discharge flow capacity that is at least as great as the peak deficit flog rate;

a trim volume coupled between the outlet of the trim compressor and the upstream side of the flow controller; and a control apparatus coupled to the trim compressor set, which controls the trim compressor set as a function of a rate-of-change of mass within the trim volume.

2. The multi-compressor system of claim 1, wherein the flow controller modulates fluid flow from the upstream side to the downstream side as a function of pressure at the downstream side.

3. The multi-compressor system of claim 1 wherein:

the base compressor set comprises at least one base compressor, and each base compressor has a respective specified base discharge pressure; and the trim compressor set comprises at least one trim compressor, and each trim compressor has a respective specified trim discharge pressure, which is greater than the specified base discharge pressures.

4. The multi-compressor system of claim 3 wherein the base compressor set comprises a plurality of base compressors, with each base compressor being coupled to the fluid distribution system.

5. The multi-compressor system of claim 3 wherein the trim compressor set comprises a plurality of trim compressors, with each trim compressor being coupled to the upstream side of the flow controller.

6. The multi-compressor system of claim 3 and further comprising a respective dryer and a respective cleaner coupled to each of the base compressor and each trim compressor.

7. The multi-compressor system of claim 1 and further comprising:

a distribution pressure sensor coupled to the fluid distribution system and providing a base distribution pressure measurement to the controller apparatus; and a trim pressure sensor coupled to the trim volume and providing a trim pressure measurement to the controller apparatus.

8. The multi-compressor system of claim 1 wherein the controller apparatus is further coupled to the base compressor set for selectively de-activating at least one base compressor within the base compressor set as a function of a rate-of-change of mass within the fluid distribution system.

9. The multi-compressor system of claim 1 wherein the controller apparatus is further coupled to the base compressor set for controlling the base compressor set as a function of a rate-of-change of mass within the trim volume.

10. The multi-compressor system of claim 1 wherein the trim volume comprises a receiver, which is coupled to the trim compressor and the upstream side of the flow controller.

11. A method of operating a multi-compressor system, comprising the steps of:

a) supplying pressurized fluid at a base discharge pressure from a base compressor to a fluid distribution system;

b) supplying pressurized fluid at a trim discharge pressure from a trim compressor to a trim volume as a function of a rate of change of mass of the pressurized fluid in the trim volume, wherein the trim volume comprises a receiver and the trim discharge pressure is greater than the base discharge pressure; and c) operating a flow controller to control flow of pressurized fluid from the trim volume to the fluid distribution system.

12. The method of claim 11 wherein the fluid distribution system has a nominal demand flow rate and a maximum peak demand flow rate and wherein:

step a) comprises supplying pressurized fluid from a base compressor set, which includes the base compressor, and wherein the base compressor set has a maximum base discharge flow capacity that is less than the maximum peak demand flow rate by a maximum peak deficit flow rate; and step b) comprises supplying pressurized fluid from a trim compressor set, which includes the trim compressor, and wherein the trim compressor set has a maximum trim discharge flow capacity that is at least as great as the peak deficit flow rate.

13. The method of claim 11 wherein step b) further comprises:

b) 2) measuring the rate of change of mass of pressurized fluid in the trim volume; and b) 3) activating the trim compressor in response to step c) to provide pressurized fluid to the trim volume and the flow controller if the rate of change of mass indicates that the mass of pressurized fluid in the trim volume is insufficient to restore pressure in the fluid distribution system to a nominal pressure.

14. The method of claim 13 wherein step b) further comprises:

b) 4) activating a further trim compressor in response to step c) to provide pressurized fluid to the receiver and the flow controller if the rate of change of mass indicates that the mass of pressurized fluid in the trim volume and the flow capacity of the first mentioned trim compressor are together insufficient to restore pressure in the fluid distribution system to the nominal pressure.

15. The method of claim 13 wherein step b) further comprises:

b) 4) activating a further base compressor in response to step c) to provide pressurized fluid to the fluid distribution system if the rate of change of mass indicates that the mass of pressurized fluid in the trim volume and the flow capacity of the trim compressor are together insufficient to restore pressure in the fluid distribution system to the nominal pressure.

16. The method of claim 11 wherein step b) comprises:

b) 2) de-activating the trim compressor as a function of the rate of change of mass in the trim volume.

17. The method of claim 16 wherein step b) further comprises:

b) 3) de-activating the base compressor as a function of a rate of change of mass in the fluid distribution system.

18. The method of claim 11 wherein step c) comprises:

c) 1) reducing flow through the flow controller if pressure in the fluid distribution system exceeds a high tolerance threshold.

19. A multi-compressor system comprising:

a fluid distribution system;

a base compressor coupled to the fluid distribution system;

a trim compressor;

a flow controller having an upstream side coupled to the trim compressor and a downstream side coupled to the fluid distribution system;

a fluid receiver coupled to the trim compressor and the upstream side of the flow controller for storing pressurized fluid; and controller means coupled to the trim compressor for controlling the trim compressor as a function of a rate-of-change of mass of the pressurized fluid stored in the trim volume.

* * * * *

UNITED STATES PATENT AND TRADEMARK OFFICE

CERTIFICATE OF CORRECTION

PATENT NO. : 6,860,103 B2
DATED : March 1, 2005
INVENTOR(S) : Sridharan Raghvachari It is certified that error appears in the above-identified patent and that said Letters Patent is hereby corrected as shown below:

Column 14,
Line 19, change “flog” to -- flow --.

Signed and Sealed this

Eighteenth Day of October, 2005

JON W. DUDAS
*Director of the United States Patent and Trademark Office*